US005308158A

United States Patent [19]

Vogelgesang et al.

[11] Patent Number: 5,308,158

[45] Date of Patent: May 3, 1994

[54] PULL DOWN STORAGE SHELF ASSEMBLY

[76] Inventors: Doug Vogelgesang, P.O. Box 2564; Douglas Ching, P.O. Box 1388, both of Kailua-Kona, Hi. 96745

[21] Appl. No.: 932,984

[22] Filed: Aug. 20, 1992

[51] Int. Cl.[5] ..... A47B 88/00

[52] U.S. Cl. ..... 312/319.3; 312/325; 211/170

[58] Field of Search ..... 312/319.3, 319.2, 325, 312/321.5, 24, 27, 334.44, 334.46; 211/170

[56] References Cited

U.S. PATENT DOCUMENTS

| | | | |
|---|---|---|---|
| 159,501 | 2/1875 | Cogswell . | |
| 2,855,262 | 10/1958 | Sharpe | 312/319.3 |
| 3,224,827 | 12/1965 | Foster et al. | 312/319.3 |
| 3,278,250 | 10/1966 | Vogt | 312/334.44 |
| 3,347,591 | 10/1967 | Soroos et al. . | |
| 3,390,930 | 7/1968 | Peterson . | |
| 3,734,588 | 5/1973 | Ellis . | |
| 4,026,434 | 5/1977 | Howard . | |
| 4,076,351 | 2/1978 | Wyant . | |
| 4,134,629 | 1/1979 | Hansen . | |
| 4,915,461 | 4/1990 | Kingsborough . | |
| 5,058,846 | 10/1991 | Close . | |

FOREIGN PATENT DOCUMENTS

| | | | |
|---|---|---|---|
| 2524962 | 12/1976 | Fed. Rep. of Germany | 312/321 |
| 3001860 | 7/1981 | Fed. Rep. of Germany | 312/334.44 |

*Primary Examiner*—Peter R. Brown
*Assistant Examiner*—Janet M. Long
*Attorney, Agent, or Firm*—Flehr, Hohbach, Test, Albritton & Herbert

[57] ABSTRACT

A pull down shelf assembly (20, 20*a*) for facilitating access to upper storage shelves (22, 22*a*). The shelf assembly includes a shelf guide track mechanism (24, 24', 24*a*, 24*a'*) and the storage shelf (22, 22*a*) slidably mounted for movement between an extended position and a retracted position. A pantographic pull down mounting assembly (26, 26', 26*a*, 26*a'*) coupled between a shelf mounting bracket (28, 28', 28*a*, 28*a'*) and the track mechanism produces pantographic movement thereof between a deployed position, for increased access, and an elevated stored position. The pantographic assembly is mounted therebetween at locations producing near-horizontal pantographic movement of the track mechanism with the storage shelf carried thereby throughout an arcuate path between the deployed position and the elevated stored position. A spring biasing mechanism (38, 38', 38*a*, 38*a'*) coupled between the mounting bracket and one of the arms biases the track mechanism toward the stored position. A shelf locking mechanism (42, 42', 42*a*, 42*a'*), positioned between the track mechanism and the storage shelf, locks the storage shelf in the extended position during movement of the track mechanism from the deployed position to the elevated stored position.

26 Claims, 4 Drawing Sheets

PULL DOWN STORAGE SHELF ASSEMBLY

TECHNICAL FIELD

The present invention relates, generally, to wall mounted storage systems, and, more particularly, to wall mounted storage systems for cabinets which raise or lower a storage shelf while maintaining a level orientation.

BACKGROUND ART

Storage shelves positioned in high places are often inaccessible to certain groups of individuals. For instance, children, the elderly and persons of shorter stature often have difficulty or are unable to reach and retrieve items stored on shelves placed high up in storage devices. Tall hallway closets or wall mounted cabinets positioned above large household appliances pose particularly difficult problems. These individuals must precariously stand on stools, ladders or the like so that they may access the stored items from the upper shelves. This practice is often dangerous, especially for children and the elderly.

Moreover, these problems are magnified for the handicapped where top shelf accessibility is even more remote. When seated in their wheelchair, retrieval of any item outside of their immediate reach is extremely difficult. Hence, most of the middle to upper storage capacity of a storage device is of little use to a handicapped person without additional aid.

In an effort to increase accessibility to the upper shelving of conventional cabinets, particularly of the wall mounted type, storage assemblies may be retrofit with pull down devices which raise or lower the shelves so that these certain groups of individuals can reach or access the stored items. These devices generally include a pantographic framework pivotally mounted to a shelf or shelves which swing the shelves outwardly and downwardly from the upper cabinets to a deployed, lowered, position for more convenient access. Generally, these devices lower the shelves while maintaining an ordinarily level orientation. Typical patented, prior art, pull down retrieval systems set may be found in U.S. Pat. Nos. 5,058,846 to Close; 4,915,461 to Kingsborough et al.; 4,134,629 to Hansen; 4,076,351 to Wyant; 4,026,434 to Howard; 3,347,591 to Soroos et al.; and 159,501 to Cogswell.

While these assemblies may been adequate to permit access of the storage assembly from the raised position, most are deficient for one reason or another. For example, the prior art assemblies do not permit the shelves, once lowered, to be pulled or extended forward for additional access. This motion provides even greater access to the storage shelf because the shelf may be moved clear of the pantographic framework where the shelves are stacked atop one another. This is especially true in multiple shelf assemblies.

In addition, many of the assemblies are inherently complex, requiring an array of pulley and linkage mechanisms, and springs biasing systems necessary to raise and lower the shelves. The Hansen patent, for instance, discloses a pantographic framework having individual link members intercoupled between a wall mounted frame, a pull down shelf, the ceiling and a folding door. This complex linkage assembly, requiring numerous parts, is very difficult to use and assemble.

Other pull down assemblies provide costly and complex mechanisms which facilitate retraction of the deployed, lowered, shelf back to the stored position. The Kingsborough patent employs an electric motor coupled to the pull down linkage mechanism by a flexible cord which draws the lowered shelf back to the stored position. This mechanism is slow to use and must be reversed to deploy the shelf to the lowered position.

The Close, Wyant and Howard patents, on the other hand, disclose pull down storage assemblies including complex pulley mechanisms or spring biasing devices configured to bias the shelf toward the raised position. These prior art assemblies include coiled springs coupled between a stationary fixture, such as a wall mounting frame, and the pull down linkage mechanism. Upon deployment of the shelf to the lowered position, the coiled springs are extended which urge the shelves back to the elevated position. Accordingly, as the user pushes the lowered shelf upward to the elevated position, the spring biased device facilitates upward movement of the shelf.

DISCLOSURE OF INVENTION

Accordingly, it is an object of the present invention to provide a pull down storage shelf assembly which permits increased access to the upper shelves of storage devices.

It is another object of the present invention to provide a pull down storage shelf assembly which efficiently urges the deployed shelf back to a stored position.

Still another object of the present invention is to provide a pull down storage shelf assembly which automatically limits the extension of a linkage assembly upon deployment to a lowered position.

It is another object of the present invention to provide a pull down storage shelf assembly which can be easily and safely operated by children, the elderly and handicapped persons.

Yet another object of the present invention is to provide a pull down storage shelf assembly which can be easily retrofit to and installed in existing storage devices.

It is a further object of the present invention to provide a pull down storage shelf assembly which is durable, compact, easy to maintain, has a minimum number of components, is easy to use by unskilled personnel, and is economical to manufacture.

The apparatus of the present invention has other objects and features of advantage which will be more readily apparent from the following description of the best mode of carrying out the invention and the appended claims, when taken in conjunction with the accompanying drawing.

The present invention includes a pull down shelf assembly having a shelf guide track mechanism and a storage shelf mounted to the track mechanism for movement of the shelf between an extended position and a retracted position. A pantographic pull down mounting assembly produces pantographic movement of the track mechanism, and hence, the storage shelf between a deployed position and an elevated stored position. The pantographic mounting assembly includes a shelf mounting bracket formed for mounting of the shelf assembly to a support member, and a pair of arms which are pivotally mounted at first ends of the arms to the track mechanism at spaced apart locations. The second ends of the arms are pivotally mounted to the shelf mounting bracket at spaced apart locations. The pair of arms are mounted to the shelf mounting bracket and the track mechanism at locations producing pantographic movement of the track mechanism with the storage shelf carried thereby and oriented in a near-horizontal orientation throughout an arcuate path between the deployed position and the elevated stored position. A spring biasing mechanism coupled between the mounting bracket and one of the arms biases the track mechanism toward the stored position.

In another aspect of the present invention, the pull down shelf assembly includes a shelf locking mechanism, positioned between the track mechanism and the storage shelf. The shelf locking mechanism includes a cam member movable between a disengaged position, releasing the locking mechanism, and an engaged position which locks the storage shelf in the extended position during movement of the track mechanism from the deployed position to the elevated stored position.

BRIEF DESCRIPTION OF THE DRAWING

The purpose and advantages of the present invention will be apparent to those skilled in the art from the following detailed description in conjunction with the appended drawings in which.

BEST MODE OF CARRYING OUT THE INVENTION

The pull down storage shelf assembly of the present invention provides accessibility of the upper shelves of a cabinet, while further, facilitating retraction of the track mechanism back to an elevated stored position. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention, as defined by the appended claims.

Figure 1:
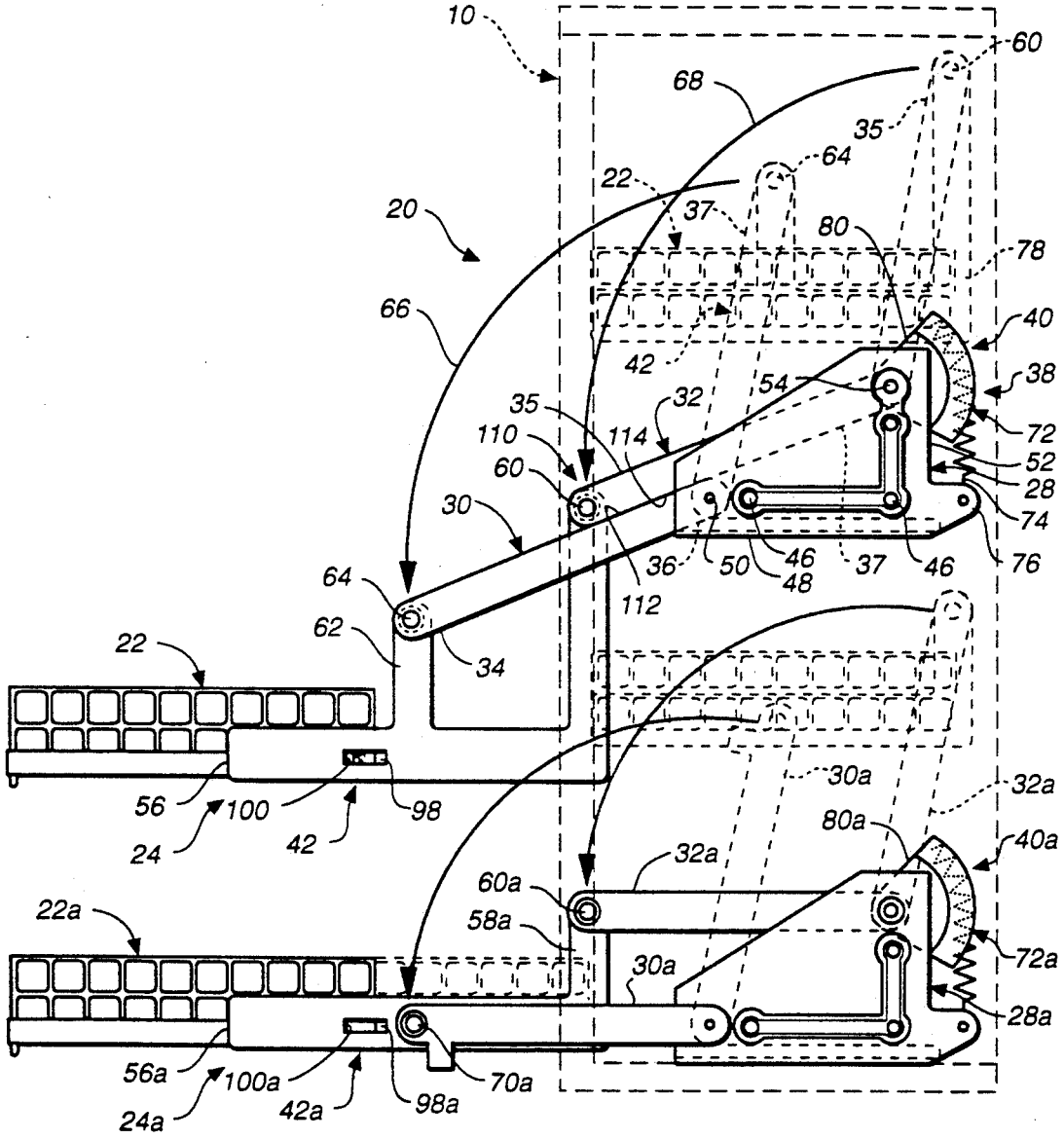
FIG. 1 is a side elevation view of a pull down shelf assembly of the present invention mounted in a cabinet and illustrating movement between a deployed position and an elevated stored position.

It will be noted here that for a better understanding, like components are designated by like reference numerals throughout the various figures. Attention is now directed to FIG. 1, where a pull down shelf assembly, generally designated 20, is illustrated mounted inside a cabinet or storage device 10 (shown in broken lines). Briefly, a pull down shelf assembly 20 of the present invention includes shelf member, generally designated 22, movably mounted to a track mechanism generally designated 24, for movement between an extended position (solid lines in FIG. 3) and a retracted position (phantom lines in FIG. 3). Shelf member 22 is formed to support items (not shown) to be stored or accessed in the upper regions of cabinet 10. Assembly 20 includes a pantographic assembly, generally designated 26, which is mounted in cabinet 10 to a support member 12 by a shelf mounting bracket member 28. A pair of arms, generally designated 30 (front arm) and 32 (rear arm), is pivotally mounted at first ends 34 and 35, respectively, to track mechanism 24 at spaced apart locations. Each opposite second end 36 and 37 of arms 30 and 32, respectively, is pivotally mounted to bracket member 28.

As shown in FIG. 1, the configuration of pull down shelf assembly 20 produces pantographic movement of track mechanism 24 throughout an arcuate path between the deployed position (solid lines in FIG. 1) and the elevated stored position (phantom lines in FIG. 1) while maintaining shelf member 22 in a substantially horizontal orientation throughout the pantographic movement. Accordingly, the stored items placed on shelf member 22 may be vertically repositioned through the arcuate lowering (via pantographic assembly 26) of track mechanism 24 without substantially disturbing the placement of the stored items relative one another.

Further, in accordance with the present invention, spring biasing means, generally designated 38, is coupled between mounting bracket member 28 and rear arm 32 which biases track mechanism 24 toward the stored position (phantom lines in FIG. 1). A spring alignment means, generally designated 40, is mounted to second end 37 of rear arm 32 which aligns the spring biasing force to direct the bending moment about second end 37. This occurs throughout the pantographic movement of track mechanism 24 between the stored position and the deployed position to more effectively urge track mechanism 24 to the stored position.

Moreover, a shelf locking mechanism generally designated 42 positioned between track mechanism 24 and shelf member 22, is movable between an engaged position (shown in FIG. 4) and a disengaged position (shown in FIG. 1) which locks shelf member 22 in the extended position. Briefly, locking mechanism 42 prevents shelf member 22 from movement back to the retracted position (phantom lines in FIG. 3) during arcuate, pantographic movement of track mechanism 24 back to the stored position (phantom lines in FIG. 1).

Figure 2:
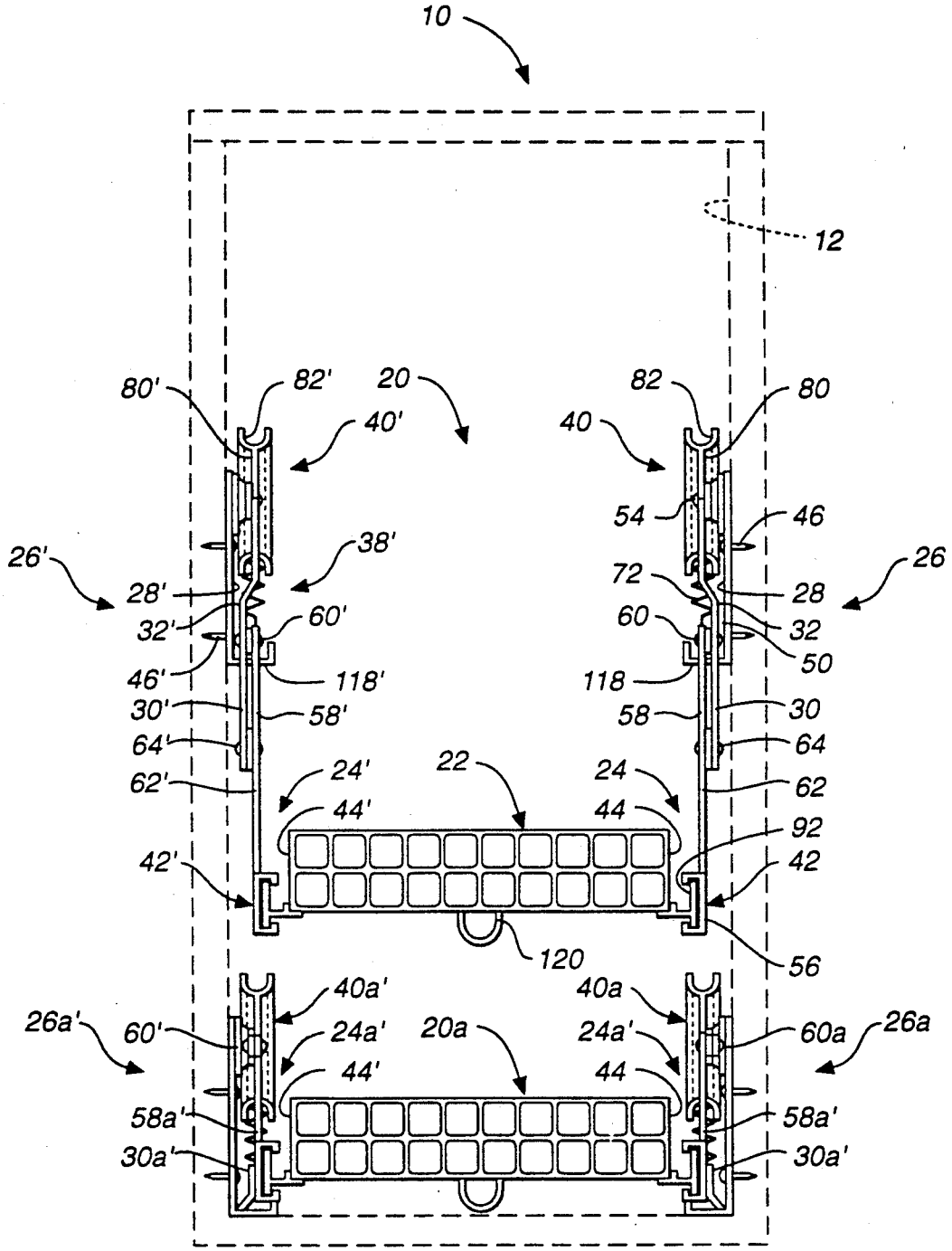
FIG. 2 is a front elevation view of the pull down shelf assembly of FIG. 1.

Attention will now be directed to FIGS. 1 and 2 where pull down assemblies 20 and **20*a* are shown mounted atop one another in cabinet 10. Although assemblies 20 and 20*a* are similar, they are not exact duplicates as will be described below. It will be appreciated that each shelf assemblies 20 and 20*a* act independently of one other so that only one assembly or more than two assemblies may be mounted in cabinet 10**, when desired.

For the ease of description, only upper pull down shelf assembly 20 will be described in great detail. Lower positioned shelf assembly **20*a*, nevertheless, will be distinguished below. In the elevated stored position (phantom lines in FIG. 1) track mechanism 24 is positioned in the upper regions of storage cabinet 10. Hence, shelf member 22, carried by track mechanism 24, is also located at its highest position relative to cabinet 10. In contrast, in the deployed position (solid lines in FIG. 1), shelf member 22 is vertically positioned at the lowest position forward of cabinet 10 where shelf member 22 is accessible. Incidently, shelf shelf member 22 may comprise any container, tray, basket, planar shelf or the like which is formed and dimensioned to hold items to be stored. Moreover, shelf member 22 may include more than one shelf member 22 stacked or housed in shelf assembly 20**.

In the preferred embodiment, pantographic assembly is provided by a pair of mirror-image pantographic assemblies 26 and 26' (FIG. 2) which are positioned on opposite sides 44 and 44' of shelf member 22. Pantographic assemblies 26 and 26', movably supporting shelf member 22, act in concert to vertically reposition track mechanism 24 between the deployed position and the stored position. It will be understood, however, that a single pantographic assembly could be employed, intermediate shelf member 22 for example, without departing from the true spirit and nature of the present invention.

Essentially, each pantographic assembly 26 and 26' is a separate four-bar linkage comprised of track mechanism 24 and 24', mounting bracket member 28 and 28', and pair of arms 30, 32 and 30', 32', respectively, mounted therebetween. Again, for the ease of description, only one pantographic (four-bar linkage) assembly 26 will be described in detail.

Mounting bracket member 28 is preferably a triangular-shaped plate member formed to be secured to support member 12 (preferably a side wall 12 of cabinet 10) by mounting fasteners 46. Pivotally coupled to a front portion 48 of bracket member 28 is front arm 30 which pivots about a generally horizontal front bracket pivotal axis 50 extending through corresponding second end 36. Similarly, pivotally coupled to an upper rear portion 52 of bracket member 28 is rear arm 32 which pivots about a generally horizontal rear bracket pivotal axis 54 extending through corresponding second end 37. As viewed in FIG. 1, rear bracket pivotal axis 54 is positioned at a location spaced apart from front bracket pivotal axis 50. Both front arm 30 and rear arm 32 are preferably elongated, substantially rigid, and similarly sized planar bars formed to support track mechanism 24, shelf member 22 and the stored items (not shown).

Figure 3:
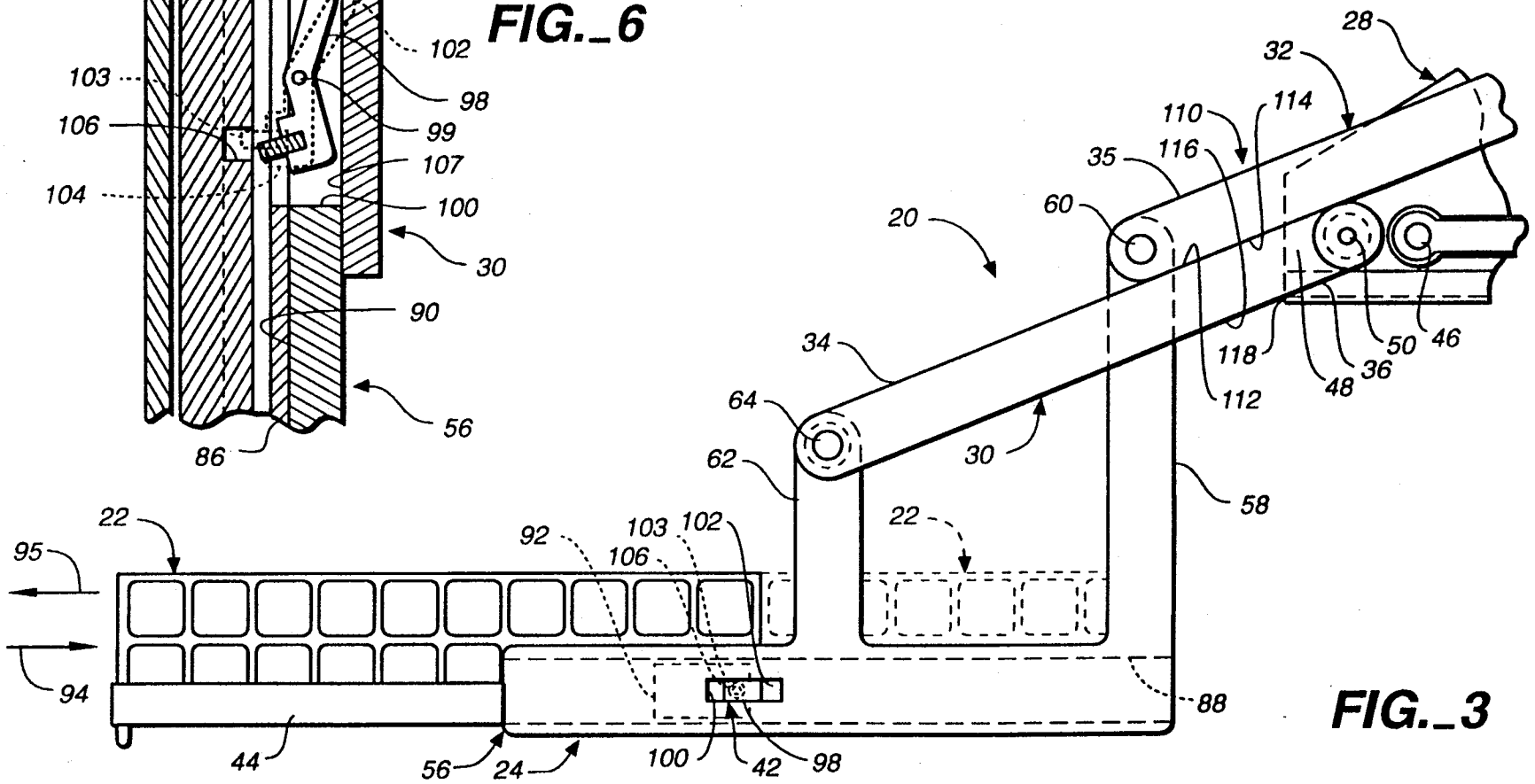
FIG. 3 is an enlarged fragmentary, side elevation view of the pull down shelf assembly in a lowered, deployed position and illustrating movement of the shelf member between a retracted position and an extended stored position.

As best illustrated in FIG. 3, track mechanism 24 includes an elongated track base portion 56 adjacently disposed on one side 44 of shelf member 22. Extending vertically upward from a rear portion of base portion 56 is a rear post member 58. The upper distal end of rear post member 58 is pivotally mounted about a generally horizontal rear post pivotal axis 60 to the corresponding first end 35 of rear arm 32. Hence, rear arm 32 movably couples track base portion 56 to support bracket member 28. Likewise, front arm 30 also movably couples base portion 56 to support bracket member 28. FIG. 1 illustrates that the upper pull down shelf assembly 20 includes a forward post member 62 extending vertically upward from an intermediate portion of track mechanism 24. Similar to rear post member 58, the upper distal end of forward post member 62 is pivotally mounted about a generally horizontal forward post pivotal axis 64 to the corresponding first end 34 of front arm 30. Rear post pivotal axis 60 is positioned at a location spaced apart from forward post pivotal axis 64 at locations producing pantographic movement of track mechanism 24 such that shelf member 22 is oriented in a near-horizontal orientation throughout the arcuate path between the deployed position and the elevated position. To achieve the desired orientation, the relative positioning (i.e., the relative direction and distance therefrom) between rear post pivotal axis 60 and forward post pivotal axis 64 on track mechanism 24 is substantially similar to the relative positioning between rear bracket pivotal axis 54 and front bracket pivotal axis 50 on bracket member 28. Moreover, the relative positioning between forward post pivotal axis 64 and front bracket pivotal axis 50 is substantially similar to the relative positioning between rear post pivotal axis 60 and rear bracket pivotal axis 54. Thus, as forward post pivotal axis 64 travels through a forward arcuate path 66 and rear post pivotal axis 60 travels through a rear arcuate path 68, front arm 30 and rear arm 32 remain substantially parallel to each other during pantographic movement of track mechanism 24 between the deployed position (solid lines in FIG. 1) and the elevated stored position (phantom lines in FIG. 1). Accordingly, such a configuration permits shelf member 22, carried by track mechanism 24, to maintain in a near-horizontal orientation throughout the arcuate path between the deployed position and the stored position as front arm 30 and rear arm pivot about front bracket pivotal axis 50 and rear bracket pivotal axis 54, respectively.

As best shown in FIG. 1, lower pull down assembly **20*a* does not include a corresponding forward post upstanding from base portion 56*a*. Rather, front arm 30*a* is pivotally mounted directly to track base portion 56*a* so that front arm 30*a* may pivot about a front track pivotal axis 70*a*. This permits adjustment of the height of track mechanism 24*a* relative to bracket member 28. To maintain the same relative positioning and relationship between the corresponding pivotal axes, as in upper pull down shelf assembly 20, the positioning or rear post pivotal axis 60*a* of lower assembly 20*a* is proportionately closer to base portion 56*a*. Accordingly, the near-horizontal orientation of shelf member 22*a* is maintained throughout the pantographic movement of track mechanism 24*a***.

Hence, depending on the length and/or absence of the forward post and the length of the rear post, the height of the track mechanism in the deployed or elevated position relative to the support bracket member can be controlled. It will also be understood that the length of the front and the rear arms also may control the height of the track mechanism.

In accordance with the present invention, spring biasing means 38 biases track mechanism 24 toward the elevated stored position. Preferably, spring biasing means 38 is provided by a coiled tension spring 72 coupled between the second end 37 of rear arm 32 and mounting bracket member 28. In particular, one end 74 of coil spring 72 is coupled to a flange portion 76 protruding rearwardly from bracket member 28, as shown in FIG. 1, while the opposite end 78 of spring 72 is secured to second end 37 of rear arm 32. When track mechanism 24 is moved to the deployed position, coiled spring 72 is extended about second end 37. Therefore, extended spring 72 exerts an opposing spring biasing force which facilitates movement of track mechanism 24 from the deployed position back to the elevated stored position.

The spring constant (K) may be varied, depending on the desired opposing force. However, the spring biasing force should not be so large as to automatically return track mechanism 24 to the elevated position without the aid of the user.

In the preferred form, spring alignment means 40 (FIG. 1) is included which align the spring biasing force in a direction which is substantially perpendicular to rear arm 32 throughout the pantographic movement of track mechanism 24 between the stored position and the deployed position. Thus, the bending moment (not illustrated), created by the spring biasing force, is always advantageously directed about rear bracket pivotal axis 54. This effectively maximizes spring use acting on rear arm 32 so that spring biasing means 38 more efficiently urges track mechanism 24 to the elevated position.

FIG. 1 illustrates that alignment means 40 is disposed proximate the second end 37 of rear arm 32. Alignment means 40 includes a circular sector plate 80 extending radially outward from the rear bracket pivotal axis 54. As best shown in FIG. 2, circular sector 80 includes a peripheral groove 82 extending from an outer edge of circular sector 80 which extends circumferentially about rear bracket pivotal axis 54. Groove 82 is formed and dimensioned for receipt of coiled spring 72 as rear arm 32 pivots about axis 54. Coil spring 72 is mounted to an upper portion of groove 82 so that spring 72 can wrap around the outer edge of circular sector 80 as track mechanism 24 is moved to the deployed position.

As viewed in FIG. 1, as coil spring 72 is disposed and aligned in groove 82 so that it wraps around sector 80 throughout movement between the deployed position and the stored position, the spring biasing force remains relatively tangential to circular sector 80. This provides a smooth and uniform lifting force to raise track mechanism 24 back to the elevated stored position.

It will be appreciated that the spring biasing means and spring alignment means combination could have been operably coupled to front arm 30 rather than rear arm 32 without departing from the nature of the present invention.

Figure 5:
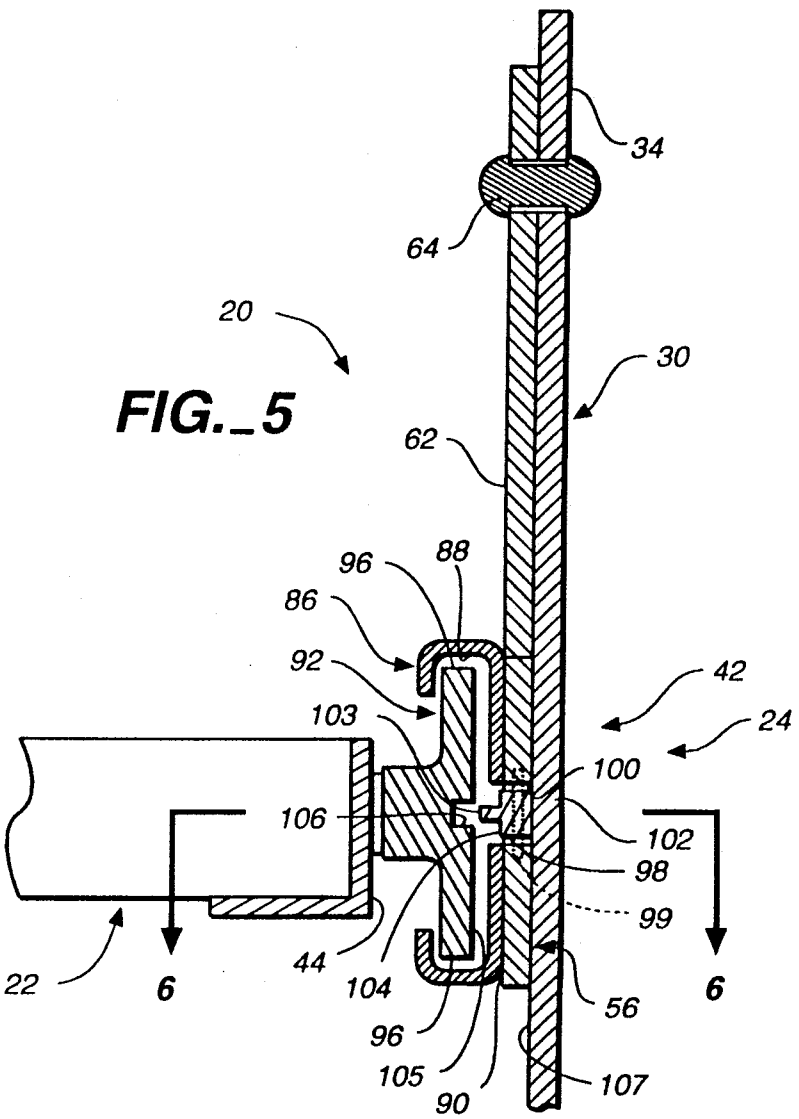
FIG. 5 is an enlarged fragmentary, front elevation view, in cross-section, of the pull down shelf assembly taken substantially along the plane of line 5—5 in FIG. 1 and illustrating disengagement of a shelf locking mechanism.
Figure 4:
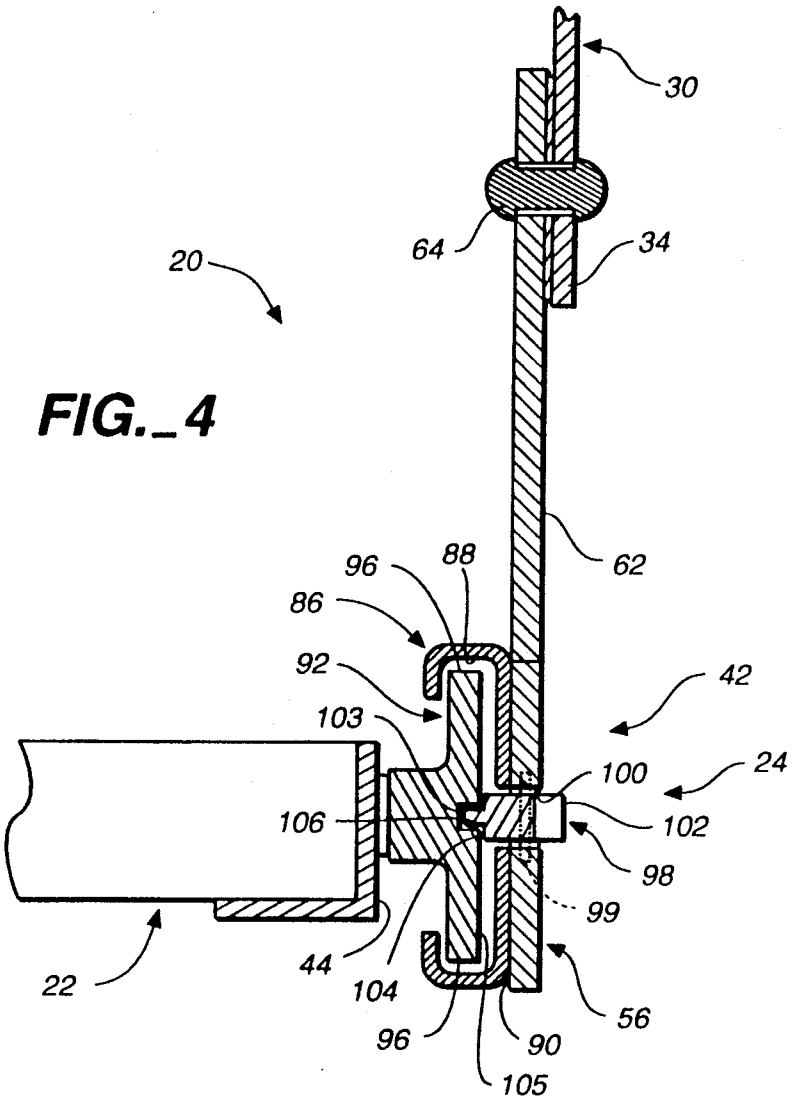
FIG. 4 is an enlarged fragmentary, front elevation view, in cross-section, of the pull down shelf assembly taken substantially along the plane of line 4—4 in FIG. 1 and illustrating engagement of a shelf locking mechanism.

In accordance with the present invention, a C-shaped bracket 86 having a channel 88 is preferably mounted to inward facing side 90 of base portion 56, as shown in FIGS. 4 and 5. C-shaped bracket extends longitudinally along base portion 56 and is positioned opposite to and adjacent side 44 of shelf member 22. Protruding outward from side 44 is an elongated T-shaped bracket element 92 mounted longitudinally along shelf member 22. Bracket element 92 is formed and dimensioned for sliding receipt and meshing engagement with channel 88 to enable shelf member 22 to slidably move relative to track mechanism 24. To move shelf member 22 forward (in the direction of arrow 94 in FIG. 3) to the extended position (shown in solid lines) or rearward (in the direction of arrow 95 in FIG. 3) to the retracted position (shown in phantom lines), opposite edges 96 of bracket member 92 engage channel 88 to slidably guide movement therethrough. When shelf member 22 is extended, increased accessibility to shelf member 22 is provided, especially for the handicapped, because shelf member 22 may be extended free and clear of from track mechanism 24. Accordingly, when track mechanism 24 is in the deployed position, the items stored on shelf member 22 are even more accessible.

It will be appreciated that track mechanism 24 could include other mechanisms which extend shelf member 22 forward and away from track mechanism 24, such as a rolling track mechanism or the like, without departing from the true spirit and nature of the present invention.

Once shelf member 22 has been extended forward while in the deployed position, it has been found desirable to prevent shelf member 22 from moving back along C-shaped channel 88 to the retracted position (phantom lines in FIG. 3) during pantographic movement of track mechanism 24 from the deployed position back to the elevated stored position. In the situation where two or more pull down shelf assemblies 20 and **20*a* are mounted atop one another, interference between upper shelf member 22 of upper assembly 20, when in the retracted position, and items stored on lower shelf member 22*a* of lower assembly 20*a* may inhibit movement from the deployed position back to the elevated stored position. As shown in FIG. 1, the arcuate movement of track mechanism 24 may cause the rear portion of upper shelf member 22 to interfere or collide with items (not shown) stored near the front of lower shelf member 22*a*. Therefore, by prohibiting retraction of shelf member 22** back to the retracted position, this problem may be effectively eliminated.

Figure 6:
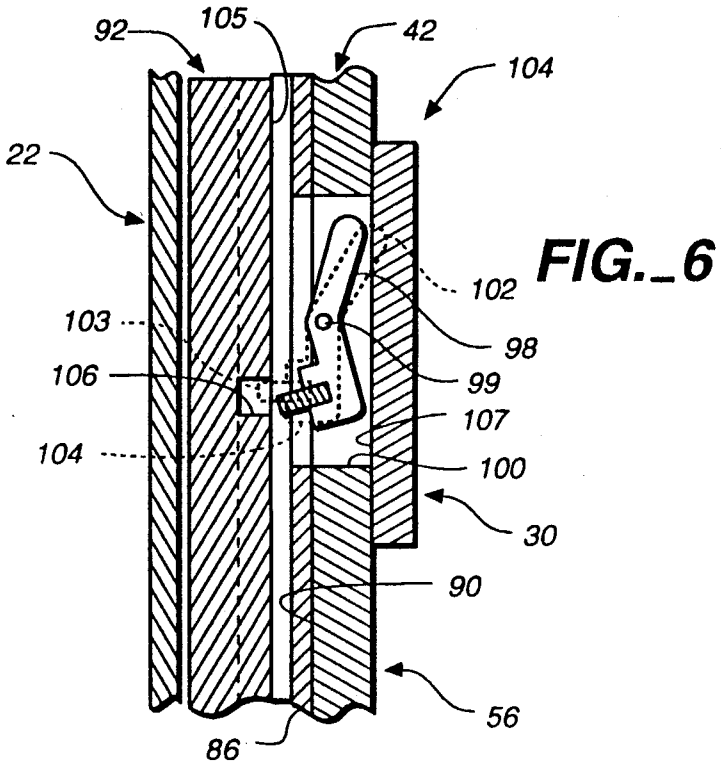
FIG. 6 is a fragmentary, top plan view, in cross-section, of the pull down shelf assembly taken substantially along the plane of line 6—6 in FIG. 5.

To prevent such retractable movement, pull down shelf assembly 20 includes shelf locking mechanism 42, as best shown in FIGS. 4–6, for releasably locking shelf member 22 in the extended position. It will be understood that locking mechanism 42 is only engaged once shelf member 22 is fully extended forward. Once locked, shelf member 22 can only be retracted when locking mechanism 42 is disengaged which releases shelf member 22. In the preferred embodiment, release occurs when track mechanism 24 is placed in the stored position and not at any time during pantographic movement of track mechanism 24 from the deployed position back to the elevated stored position. Subsequently, shelf member 22 may be moved along channel 88 of track mechanism 24 to be retracted back into cabinet 10, as shown in phantom lines in FIG. 1.

In the preferred embodiment, locking mechanism 42 releasably engages T-shaped bracket element 92 which prevents extended shelf 22 from moving towards the retracted position. Locking mechanism 42 includes a cam member 98 pivotally mounted about a vertical pin member 99 permitting reciprocation between an engaged position (phantom lines in FIG. 6), preventing shelf member 22 from moving to the retracted position, and a disengaged position (solid lines in FIG. 6), where shelf member 22 is free to reciprocate relative channel 88. An aperture 100 extends through both base portion 56 and C-shaped bracket 86 so that a cam surface 102 of cam member 98 can protrude beyond base portion 56. A compression spring (not shown) biases cam member 98 in the engaged position by urging cam member 98 outwardly through aperture 100 (clockwise in FIG. 6). Hence, a locking pin 103 mounted to an end 104 opposite cam surface 102 slidably engages an outwardly facing surface 105 of T-shaped bracket 92. Once shelf member 22 is moved forward in the direction of arrow 94 (FIG. 3) to the fully extended position, the compression spring urges locking pin 103 into receivable engagement with a locking recess 106 provided in surface 105 of T-shaped bracket 92 (shown in phantom lines in FIG. 6). Accordingly, shelf member 22 will be releasably locked into the extended position illustrated in solid lines in FIG. 3 until locking mechanism 42 is disengaged.

Locking mechanism 42 includes release means operably coupled thereto for releasing locking mechanism 42 from the engaged position. The release mechanism is preferably engaged along the arcuate pantographic movement of track mechanism 24 just before it reaches the elevated stored position (shown in phantom lines in FIG. 1). As best viewed in FIGS. 1, 5 and 6, locking mechanism 42 is disengaged when front arm 30 physically engages cam member 98 pushing it inwardly pivotally withdrawing locking pin 103 from locking recess 106. FIG. 1 illustrates that as front arm 30 pivots about forward post pivotal axis 64 when track mechanism 24 is near the elevated stored position, a planar surface 107 (FIGS. 5 and 6) of front arm 30 contacts a cam surface 102 of cam member 98. Hence, front arm 30 urges cam member 98 about pin member 99 (counterclockwise in FIG. 6) which disengages locking mechanism 42 and, in turn, compresses the compression spring (not shown). Shelf member 22 is subsequently released and can be retracted relative to track mechanism 24.

Accordingly, aperture 100 must be strategically positioned along track base portion 56 so that front arm 30 can physically engage front arm 30 when track mechanism 24 is moved to the stored position. The point of disengagement of locking mechanism 42, along the forward arcuate path 66 of forward post pivotal axis 64, is determinative and can be controlled by the placement of cam member 98 along base portion 56. Moreover, it will be understood that cam member 98 could have been positioned along base portion 56 such that rear arm 32 would be the cam engaging arm. Further, although preferably upper assembly 20 includes locking mechanisms 42 and 42*a*, only one mechanism may be necessary.

Referring back to FIG. 1, it may be viewed that front arm 30*a* includes an engaging flange portion 108*a* protruding outwardly from the side of front arm 30*a*. Because lower assembly 20*a* is free of a forward post upstanding from corresponding base portion 56*a*, front arm 30*a* does not pivot about front bracket pivotal axis 50*a* through forward arcuate path 66*a* by an angle sufficient to contact cam surface 102*a* of cam member 98*a* while in the stored position. Accordingly, front arm 30*a* includes flange portion 108*a* formed and positioned to engage cam surface 102*a* when shelf member 22*a* is moved to the elevated stored position (phantom lines in FIG. 1).

Deployment limiting means 110, as best shown in FIG. 3, are preferably included which limit the downward deployment of track means 24 in upper assembly 20. An upward facing surface 112 of front arm 30 engages a downward facing surface 114 of rear arms 32 at the deployed position which prevents further arcuate motion. Accordingly, in the preferred form, arms 30 and 32 pivotally move about forward and rear post pivotal axis 50 and 54, respectively, in substantially the same plane so that upward facing surface 112 may engage downward facing surface 114. Moreover, the bottom edge 116 of front arm 30 abuts a front ledge 118 of bracket member 28 so that front arm 30 may rest thereagainst. These two limiting functions cooperate to limit the deployment of track mechanism 24.

In another embodiment of the present invention, shelf member 22 includes an access loop 120 formed to facilitate extension or retraction of shelf member 22. Handicapped persons may have difficulty pulling shelf member 22 outwardly to the extended position for access. Therefore, as shown in FIG. 1, access loop 120 extends downwardly intermediate the front bottom surface of shelf member 22 to provide a receptacle for engagement with a hook device (not shown). Manual operation of the hook device, which is probably mounted to an elongated member, permits the handicapped person to engage loop 120 so that shelf member 22 may be extended outwardly and then downwardly to the deployed position.

What is claimed is:

1. A pull down shelf assembly comprising:

a shelf guide track mechanism;

a storage shelf member mounted to said track mechanism for movement between an extended position and a retracted position;

a pantographic assembly including a shelf mounting bracket member formed for mounting of said shelf assembly to a support member, and a pair of arms pivotally mounted at first ends to said track mechanism at spaced apart locations and pivotally mounted about a pivotal axis at second ends to said mounting bracket member at spaced apart locations, said pair of arms being mounted to said mounting bracket member and said track mechanism at locations producing pantographic movement of said track mechanism with said shelf member carried thereby and oriented in a near-horizontal orientation throughout an arcuate path between a deployed position and an elevated stored position;

a spring biasing mechanism coupled between said bracket member and one of said arms for biasing said track mechanism toward said stored position; and a spring alignment mechanism mounted to a rear arm of said pair of arms proximate said second end and formed to align a spring biasing force, caused by said spring biasing mechanism and acting on said rear arm, in a substantially similar direction throughout said pantographic movement of said track mechanism between the stored position and the deployed position, said spring biasing mechanism including a substantially vertically disposed coil spring having one end coupled to an upper portion of said alignment mechanism and an opposite end to said bracket member.

2. A pull down shelf assembly as defined in claim 1 wherein, said alignment mechanism includes a spring receiving groove circumferentially disposed about the pivotal axis of said second end and formed and dimensioned to receive said coil spring.

3. The pull down shelf assembly as defined in claim 1 further including:

a shelf locking mechanism positioned between said track mechanism and said shelf member and movable between an engaged position, locking said shelf member in the extended position during movement of said track mechanism from said deployed position to said elevated stored position, and a disengaged position.

4. The pull down shelf assembly as defined in claim 3 wherein, said shelf locking mechanism includes a release mechanism operably coupled thereto for releasing said locking mechanism to said disengaged position, said release mechanism being positioned for engagement with one of said arms when said track mechanism is in said elevated position to release said locking mechanism and enabling said shelf member to be moved to said retracted position.

5. The pull down shelf assembly as defined in claim 4 wherein, said release mechanism includes a cam member pivotally mounted to a side portion of said track mechanism, and said track mechanism defining an aperture extending therethrough formed and dimensioned to receive said cam member pivotal between said engaged position, engaging said locking mechanism, and said disengaged position, releasing said locking mechanism.

6. The pull down shelf assembly as defined in claim 5 wherein, said aperture is positioned so that a front arm of said pair of arms contacts said cam member urging said cam member toward said disengaged position when said track mechanism is in said elevated position.

7. The pull down shelf assembly as defined in claim 5 wherein, said locking mechanism includes a compression spring biasing said cam member toward said engaged position.

8. A pull down shelf assembly as defined in claim 1 wherein, said track mechanism includes a rear post extending upward therefrom and pivotally mounted to a rear arm of said pair of arms at said first end.

9. A pull down shelf assembly as defined in claim 8 wherein, said track mechanism includes a forward post extending upward therefrom and forward of said rear post, and pivotally mounted to a front arm of said pair of arms at said first end.

10. A pull down shelf assembly as defined in claim 9 wherein, said forward post and said rear post are substantially vertically disposed.

11. A pull down shelf assembly as defined in claim 9 wherein, said front arm and said rear arm include deployment limiting means limiting pantographic movement of said track mechanism to the deployed position.

12. A pull down shelf assembly as defined in claim 11 wherein, said limiting mechanism includes a front arm engaging surface defined by said front arm, and a rear arm, engaging surface defined by said rear arm, said front arm engaging surface being formed to abut said rear arm engaging surface in said deployed position.

13. A pull down shelf assembly as defined in claim 12 wherein, said front arm and said rear arm pivotally move in substantially the same plane.

14. A pull down shelf assembly as defined in claim 1 wherein, said pantographic assembly include a pair of laterally spaced apart pantographic assemblies positioned on opposite sides of said shelf member.

15. A pull down shelf assembly as defined in claim 14 wherein, each track mechanism of each said pantographic assembly includes an elongated track base portion adjacently disposed along said opposite sides of said shelf member.

16. A pull down shelf assembly as defined in claim 15 wherein, each said base portion defines C-shaped channels extending longitudinally therealong and formed to slidably receive opposing sides of said shelf member for guiding movement of said shelf means relative to said base portions between said extended position and said retracted position.

17. A pull down shelf assembly as defined in claim 16 wherein, said opposing sides of said shelf member include bracket elements formed for slidable receipt in said C-shaped channels.

18. A pull down shelf assembly comprising:

a shelf guide track mechanism;

a storage shelf member mounted to said track mechanism for movement between an extended position and a retracted position;

a pair of laterally spaced apart pantographic pull down assemblies each including shelf mounting bracket member formed for mounting of said shelf assembly to a support member, and each including a pair of arms pivotally mounted at first ends to said track mechanism at spaced apart locations and pivotally mounted at second ends to said mounting bracket member at spaced apart locations, each said pair of arms being mounted to said mounting bracket member and said track mechanism at locations producing pantographic movement of said track mechanism with said shelf member carried thereby and oriented in a near-horizontal orientation throughout an arcuate path between a deployed position and an elevated stored position;

a spring biasing mechanism coupled between said bracket member and one of said arms for biasing said track mechanism toward said stored position;

a spring alignment mechanism mounted to said one of said arms proximate said second end and formed to align a spring biasing force, caused by said spring biasing mechanism and acting on said second end, in a substantially similar direction during said pantographic movement of said track mechanism between the stored position and the deployed position; and a shelf locking mechanism positioned between one of said track mechanism and said shelf mechanism and movable between an engaged position and a disengaged position for locking said shelf member in an extended position during movement of said track mechanism from said deployed position to said elevated stored position.

19. A pull down shelf assembly comprising:

a shelf guide track mechanism;

a storage shelf member mounted to said track mechanism for movement between an extended position and a retracted position;

a pantographic assembly including a shelf mounting bracket member formed for mounting of said shelf assembly to a support member, and a pair of arms pivotally mounted at first ends to said track mechanism at spaced apart locations and pivotally mounted about a pivotal axis at second ends to said mounting bracket member at spaced apart locations, said pair of arms being mounted to said mounting bracket member and said track mechanism at locations producing pantographic movement of said track mechanism with said shelf member carried thereby and oriented in a near-horizontal orientation throughout an arcuate path between a deployed position and an elevated stored position; and a shelf locking mechanism positioned between said track mechanism and said shelf member and movable between an engaged position, locking said shelf member in the extended position during movement of said track mechanism between said deployed position and said elevated stored position, and a disengaged position.

20. The pull down shelf assembly as defined in claim 19 wherein, said shelf locking mechanism includes a release mechanism operably coupled thereto for releasing said locking mechanism to said disengaged position, said release mechanism being positioned for engagement with one of said arms when said track mechanism is in said elevated position to release said locking mechanism and enabling said shelf member to be moved to said retracted position.

21. The pull down shelf assembly as defined in claim 20 wherein, said release mechanism includes a cam member pivotally mounted to a side portion of said track mechanism, and said track mechanism defining an aperture extending therethrough formed and dimensioned to receive said cam member pivotal between said engaged position, engaging said locking mechanism, and said disengaged position, releasing said locking mechanism.

22. The pull down shelf assembly as defined in claim 21 wherein, said aperture is positioned so that a front arm of said pair of arms contacts said cam member urging said cam member toward said disengaged position when said track mechanism is in said elevated position.

23. The pull down shelf assembly as defined in claim 21 wherein, said locking mechanism includes a compression spring biasing said cam member toward said engaged position.

24. The pull down shelf assembly as defined in claim 19 further including:

a spring biasing mechanism coupled between said bracket member and one of said arms for biasing said track mechanism toward said stored position.

25. The pull down shelf assembly as defined in claim 19 wherein, said pantographic assembly include a pair of laterally spaced apart pantographic assemblies positioned on opposite sides of said shelf member.

26. The pull down shelf assembly as defined in claim 25 wherein, each track mechanism of each said pantographic assembly includes an elongated track base portion adjacently disposed along said opposite sides of said shelf member.

* * * * *